United States Patent [19]

Wank et al.

[11] Patent Number: 5,056,617

[45] Date of Patent: Oct. 15, 1991

[54] DIAPHRAGM FOR LOUDSPEAKER

[75] Inventors: Joachim Wank, Dormagen; Werner Waldenrath, Cologne; Dieter Freitag, Krefeld, all of Fed. Rep. of Germany

[73] Assignee: Bayer Aktiengesellschaft, Fed. Rep. of Germany

[21] Appl. No.: 405,278

[22] Filed: Sep. 8, 1989

[30] Foreign Application Priority Data

Sep. 17, 1988 [DE] Fed. Rep. of Germany ..... 3831706

[51] Int. Cl.[5] ..... G10R 13/00; H04K 7/00

[52] U.S. Cl. ..... 181/173; 381/204

[58] Field of Search ..... 181/157, 161, 163–165, 181/173, 174, DIG. 1; 381/186, 194, 197, 204

[56] References Cited

U.S. PATENT DOCUMENTS

| | | | |
|---|---|---|---|
| 3,172,498 | 3/1965 | Gorike | 181/167 |
| 3,285,364 | 11/1966 | Cohen | 181/167 X |
| 3,553,392 | 1/1971 | Liebscher | 181/167 X |
| 3,578,104 | 5/1971 | Sotome | 181/167 X |
| 3,586,121 | 6/1971 | Sotome | 181/167 |
| 3,612,783 | 10/1971 | Schneider | 181/167 X |
| 3,862,376 | 1/1975 | White | 181/167 X |
| 4,190,746 | 2/1980 | Harwood et al. | 181/167 |

*Primary Examiner*—Brian W. Brown

*Attorney, Agent, or Firm*—Connolly & Hutz

[57] ABSTRACT

The positive characteristics of loudspeaker diaphragms are improved by the use of a thermoplastic polyurethane sheet with a thickness of 0.06 to 0.8 mm at least for the moving part (1).

7 Claims, 1 Drawing Sheet

DIAPHRAGM FOR LOUDSPEAKER

Figure 1:
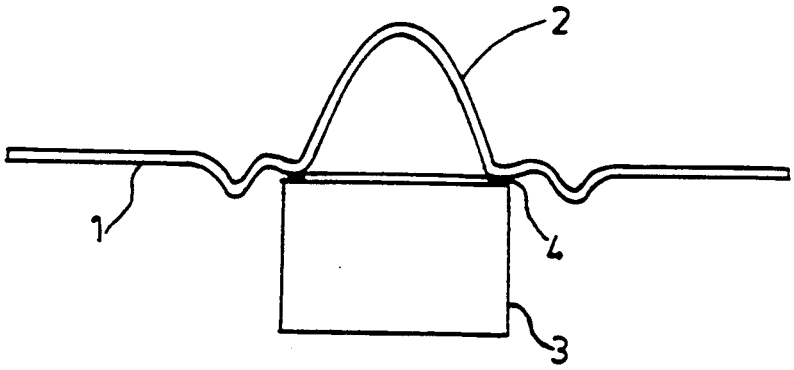

The invention relates to a diaphragm for a loudspeaker, consisting of a moving part with a cap-shaped dome or cone, in which at least the moving part is made from plastic sheet material.

There are essentially two diaphragm systems in current use. In the first system both the cap-shaped dome and the moving part which surrounds it are made from a piece of identical sheet material, such as paper, strawboard bound with phenol resin, impregnated fabric, polyamide, polycarbonate. In the second system the cap-shaped dome or the cone and the moving part are made from different materials and are glued together. Polyamide sheet or impregnated fabric is usually used for the moving part, and in particular sheet material made from titanium, strawboard bound with phenol resin, aluminium or polycarbonate, are used for the cap-shaped dome or cone. The first system has a high degree of efficiency but a narrow transmission range and a limited range of applications. The second system has a wide transmission range, shows a very low resonance frequency and offers good reproduction, but has a low degree of efficiency. As a rule cone diaphragms are made according to the second principle and accordingly have advantages and disadvantages. In both system the connection of the moving coil to the diaphragm represents a critical point because it is very difficult to apply glue evenly.

The object of the invention is to provide a diaphragm for a loudspeaker which combines the positive characteristics of both of the known systems.

This object is achieved in that the plastic sheet is made from thermoplastic polyurethane and has a thickness of 0.02 to 0.8 mm.

In this way a high degree of efficiency is achieved with a wide transmission range and a low resonance frequency by comparison with similar loudspeaker constructions and dimensions. Such diaphragms respond more quickly, as a result of which the natural sound pattern is considerably improved. In addition, substantially higher frequencies can be transmitted with the novel diaphragm. The use of thermoplastic polyurethane sheets also offers advantages from the point of view of production techniques: They are weldable and more readily deformable, and by comparison with the previously used materials they have a higher temperature resistance; as a result of better adaptation to the geometry there is a markedly improved frequency quality and a better tone quality, so that the distortion factor is also reduced. Because of the improved deformability diaphragms with a higher cap-shaped dome or lower cone than previously used can be produced from one piece. However, even when it is necessary to produce the moving part and the cap-shaped dome or cone separately because of extreme dimensions, there is the advantage that as a rule the moving part made from thermoplastic polyurethane sheet can be welded to the cap-shaped dome or cone. As a result the critical glued connection is omitted not only on the moving coil but also between the moving part and the cap-shaped dome or cone. It goes without saying that in the welded construction both the moving part and the cap-shaped dome or cone are preferably made from thermoplastic polyurethane sheet. However, all the materials which have been used in the past are also suitable for the cap-shaped dome and cone. The necessary sheets can be produced from thermoplastic polyurethane both by the blown sheet process and by the flat sheet process.

A number of embodiments of the polyurethane sheet to be used suggest themselves:

According to a first embodiment this sheet is a polyester polyurethane sheet with a thickness of 0.11 to 0.6 mm.

Suitable polyester polyurethanes can be produced in accordance with DE-OS 28 42 806.

Accordance to a second embodiment the polyurethane sheet is a polyether polyurethane sheet with a thickness of 0.08 to 0.7 m.

Suitable polyether polyurethanes can be produced in according with DE-OS 23 02 564.

Accordance to a third embodiment the polyurethane sheet is a polyethercarbonate polyurethane sheet with a thickness of 0.08 to 0.7 mm.

Suitable polyethercarbonate polyurethanes can be produced in according with DE-OS 22 48 328.

Particularly good results have been shown when the modulus of shear (according to DIN 53 445) of the polyurethane sheet in the range between 0° and 140° C. is between $10^0$ and $10^1$ MPa, particularly between $2\times10^0$ and $8\times10^0$ MPa.

Further improvements are shown if the hardness (according to DIN 53 305) of the polyurethane sheet measured in accordance with Shore A is in the range 80 to 96 Shore, particularly in the range 85 to 90 Shore, and measured in accordance with Shore D is between 30 and 60 Shore, particularly between 30 and 45 Shore.

The yield stress (10% expansion) of the polyurethane sheet is preferably between 1.0 and 10 MPa, particularly between 1.2 and 4 MPa.

Figure 2:
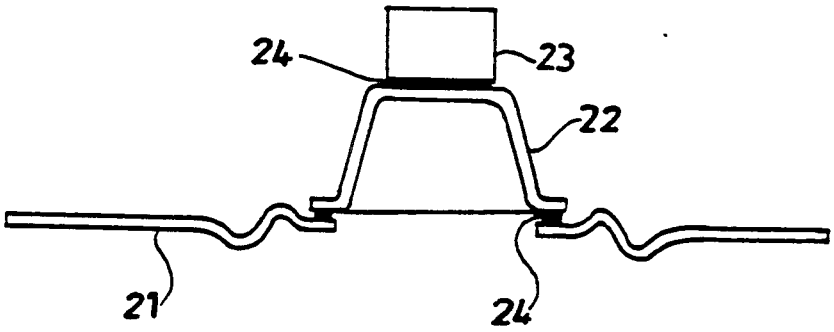
Figure 3:
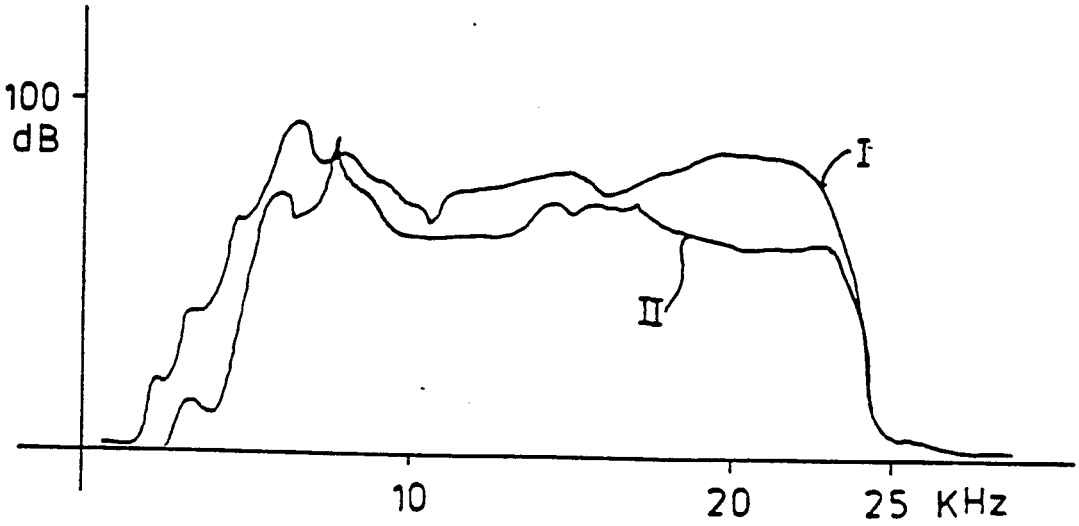

The new diaphragm is shown purely schematically in two embodiments in the drawings, and its properties are reproduced in a diagram and appropriately explained in greater detail. In the drawings:

FIG. 1 shows a section through a diaphragm with a cap-shaped dome made from one piece, FIG. 2 shows a section through a diaphragm with a cone, in which the moving part and the cone are made from two pieces which are welded together, FIG. 3 shows a diagram of the frequency curve of the diaphragms according to FIGS. 1 and 2.

In FIG. 1 the diaphragm is made from one single piece of thermoplastic sheet 0.18 mm thick which has a modulus of shear of $5\cdot10^0$ MPa, a Shore A hardness of 87 Shore and a Shore D hardness of 34 Shore as well as a yield stress of 1.5 MPa and is made by the blowing process from a polyethercarbonate polyurethane with the molar weight of 40,000. The diaphragm has a diameter of 25 mm and is made from an annular moving part 1 which turns into a cap-shaped dome 2 with an external diameter of 19 mm without any seams. This diaphragm is produced by thermal deformation. Instead of the usual glued connection, a moving coil 3 is fixed by a welded connection 4 at the transition between the moving part 1 and the cap-shaped dome 2. For this purpose the moving coil 3 is heated to 160° C. and pressed into the appropriate position and thereby welded to the sheet material.

In FIG. 2 the cone diaphragm consists of a moving part 21 made from a polyurethane sheet which is made in the flat sheet process and has a thickness of 0.25 mm, a modulus of shear at 20° C. of $8\cdot10^0$ MPa, a Shore A hardness of 88 Shore and a Shore D hardness of 33 Shore as well as a yield stress of 1.6 MPa. The opening of the moving part 21 is filled by a cone 22 which has an external diameter of 19 mm and is made from titanium sheet 0.04 mm thick, and the moving part 21 and the cone overlap and are welded together. This welded connection 24 is produced by means of a hot stamp heated to 180° C. After this operation the moving coil 23 is fixed in the same manner as described in connection with FIG. 1, so that a further welded connection 24 is produced.

The frequency curves of the diaphragms illustrated in FIGS. 1 and 2 are shown in FIG. 3, in which the curve I corresponds to the diaphragm illustrated in FIG. 1 and the curve II corresponds to the diaphragm illustrated in FIG. 2. The rapid response capability and the transmissibility of higher frequencies is clearly recognisable.

We claim:

1. Diaphragm for loudspeaker, consisting of a moving part (1, 21) with a cap-shaped dome or cone, in which at least the moving part (1,21) is made from a plastic sheet of thermoplastic polyurethane having a thickness of 0.02 to 0.8 mm, a modulus of shear according to between $10^0$ and $10^1$ MPa in a range 0° to 140° C., a hardness according to in a range of 80 to 96 Shore A and in a range of 30 to 60 Shore D, and a yield stress in a range of 1.0 to 10 MPa.

2. Diaphragm as claimed in claim 1, characterised in that the plastic sheet is a polyester polyurethane sheet with a thickness of 0.1 to 0.6 mm.

3. Diaphragm as claimed in claim 1, characterised in that the plastic sheet is a polyether polyurethane sheet with a thickness of 0.08 to 0.7 mm.

4. Diaphragm as claimed in claim 1, characterised in that the plastic sheet is a polyethercarbonate polyurethane sheet with a thickness of 0.08 to 0.7 mm.

5. Diaphragm as claimed in claim 1, wherein the the modulus of shear of the polyurethane sheet is in a range between $2\times10^0$ and $8\times10^0$ MPa.

6. Diaphragm as claimed in claim 1, wherein the hardness of the polyurethane sheet measured in accordance with Shore A is in the range of 85 to 90 Shore, and measured in accordance with Shore D is between 30 and 45 Shore.

7. Diaphragm as claim in claim 1, wherein the yield stress of the polyurethane sheet is between 1.2 and 4 MPa.

* * * * *